US006358011B1

(12) United States Patent
Tetu et al.

(10) Patent No.: US 6,358,011 B1
(45) Date of Patent: Mar. 19, 2002

(54) RADIAL FAN BLADE CONFIGURATION

(75) Inventors: Lee G. Tetu, Baldwinsville; Richie C. Stauter, Fayetteville, both of NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/653,860

(22) Filed: Sep. 1, 2000

(51) Int. Cl.[7] ..... F04D 29/28
(52) U.S. Cl. ..... 416/186 R; 416/244 R
(58) Field of Search ..... 416/185, 186 R, 416/186 A, 188, 223 B, 244 R

(56) References Cited

U.S. PATENT DOCUMENTS 1,367,766 A * 2/1921 Bozied ..... 416/185
1,882,961 A * 10/1932 Saunders ..... 416/186 A
5,558,499 A * 9/1996 Kobayashi ..... 416/186 R

FOREIGN PATENT DOCUMENTS

DE 1935013 A * 1/1971 ..... 416/185
DE 3637464 A1 * 5/1988 ..... 416/223 B

* cited by examiner

*Primary Examiner*—Christopher Verdier

(57) ABSTRACT

A fan blade configuration for a radial fan includes support structure for the cantilevered portion of each blade. This support structure is preferably affixed to an upper circumferential ring of the radial fan and extends outwardly therefrom in support of the cantilevered portion of the blade. The support structure preferably extends along the cantilevered portion of the blade for a predefined distance. The distance is preferably expressed relative to a distance to a point at which the leading edge of the blade terminates. The predefined distance is also a function of the downward inclination of the support structure extending along the cantilevered portion. The support structure extends underneath the outer ring so as to define an aligning surface for the rearward portion of the respective fan blade.

11 Claims, 3 Drawing Sheets

RADIAL FAN BLADE CONFIGURATION

BACKGROUND OF THE INVENTION

This invention relates to radial fans used to move or draw air through a heat exchanger, and in particular to the blade configuration of such fans.

Radial fan blades are usually configured to produce an optimum flow of air through or over a heat exchanger at a particular speed of rotation of the fan. It is difficult to significantly increase the volumetric flow of air for a given radial fan without substantially redesigning the radial fan blades. This can include either changing the shape or thickness of the fan blade so as to increase the rigidity of the fan blades to handle the increased flow of air. It would be preferable to increase the rigidity of the fan blades without necessarily going through a substantial redesign of the fan blades.

SUMMARY OF THE INVENTION

The invention features a fan blade configuration for a radial fan that includes support structure for the cantilevered portion of each blade. The support structure increases the rigidity of the cantilevered portion of said blade so as to allow the radial fan to operate at higher speeds. This support structure is preferably affixed to an upper ring of the radial fan and extends outwardly therefrom in support of the cantilevered portion of the blade. The support structure preferably extends along the cantilevered portion of the blade for a predefined distance. The distance is preferably expressed relative to a distance to a point at which the leading edge of the blade terminates. The predefined distance is also a function of the downward inclination of the support structure extending along the cantilevered portion.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
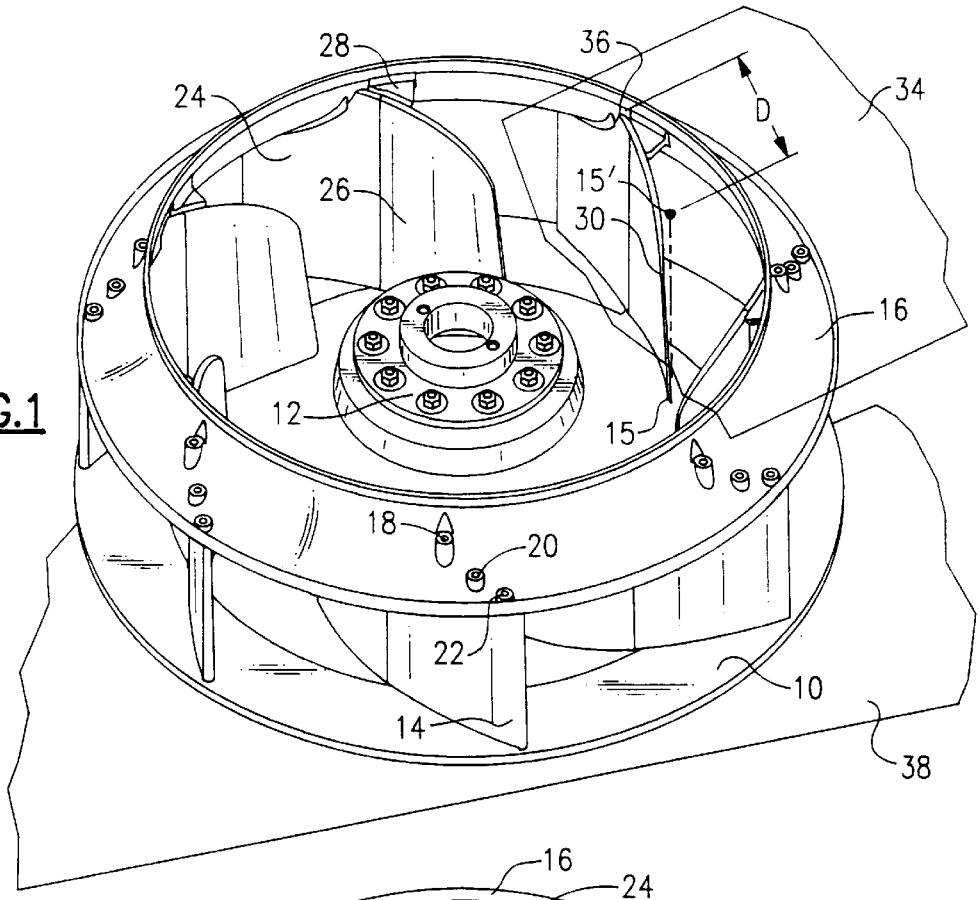
FIG. 1 is a perspective view of a radial fan having a blade configuration and associated supporting structure in accordance with the present invention.

Referring to FIG. 1, a radial fan assembly comprises a bottom portion 10 having a hub 12, which is preferably mounted to a drive shaft (not shown) of a motor for rotation. The fan assembly furthermore includes a series of fan blades such as 14, which project inwardly toward the hub 12 from the periphery of the bottom portion 10. The leading edge of each fan blade terminates at a point such as 15 on the top surface of the bottom portion 10. The fan blades 14 are preferably formed with the bottom portion 10 in a mold so as to be a single unitary molded piece. A top ring portion 16 is preferably affixed to a series of projections from each fan blade such as 18, 20 and 22. The top ring 16 is affixed to these projections by a suitable processor such as ultrasonic welding.

Each of the fan blades includes a rear blade portion, such as 24, which lies underneath the top ring portion 16. The rear blade portion contains the projections 18, 20 and 22 that extend up through the top ring 16 as has been previously described. Each blade furthermore includes a cantilevered portion such as 26 extending outwardly from the inner periphery of the top ring portion 16. A blade support such as 28 is positioned between the top ring 16 and the cantilevered portion of each blade in order to increase the rigidity of the blade. The blade support extends outwardly from an inner wall 29 of the top ring portion 16 towards the center of rotation of the fan assembly through the hub 12.

Figure 2:
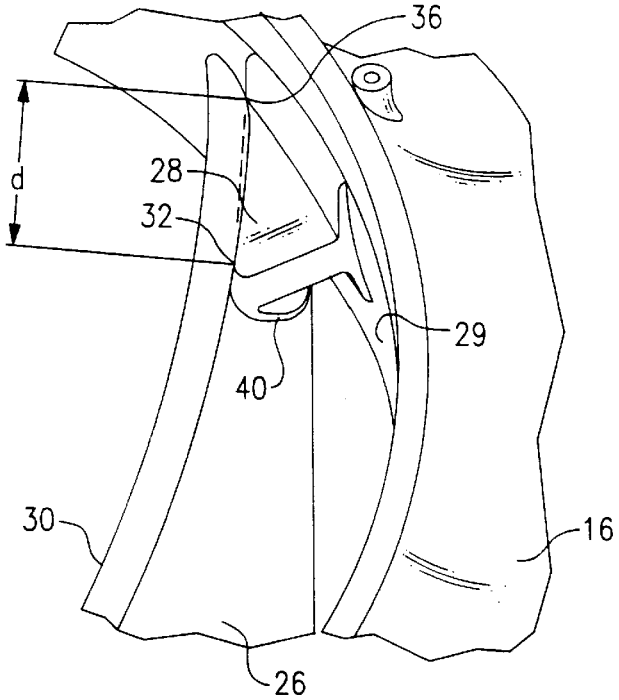
FIG. 2 is a detailed perspective view of the support structure associated with a single blade configuration of the radial fan of FIG. 1.
Figure 3:
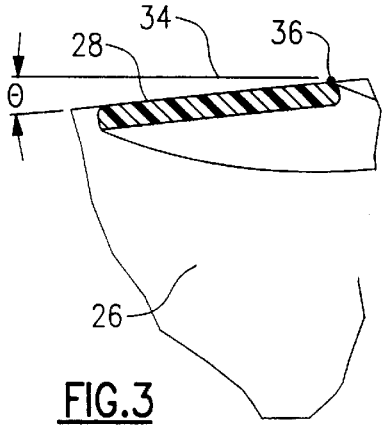
FIG. 3 is a cross sectional view of the support structure of FIG. 2.

Referring to FIG. 2, the blade support 28 is illustrated relative to the cantilevered fan blade portion 26. The top of the blade support 28 is web shaped and follows the contour of the inner wall 29 of the top ring portion 16 as well as the contour of the nearest side of the cantilevered fan blade portion 26. The top of the web-shaped portion 28 is preferably flat and angles downwardly in order to follow the contour of the side of the cantilevered blade portion 26 for a sufficient distance before intersecting the top edge 30 of the cantilevered blade portion at a point 32. This downward orientation of the top of the web shaped portion is dictated in large part by the curvature of the top edge 30 of the cantilevered blade portion 26, as seen in FIG. 1. The angle of inclination of the top of the web-shaped portion 28 is clearly shown in FIG. 3, which is a cross sectional view taken along the cross sectional view lines 3—3 in FIG. 4. The angle of inclination, $\theta$, of the top of the blade support 28 is illustrated relative to a plane 34 passing through a point 36. Referring to FIG. 3, the point 36 marks the beginning of the preferably flat top surface of the support 28 with respect to the side of the cantilevered blade portion 26. Referring to FIG. 1, the plane 34 passing through the point 36 is illustrated relative to a flat plane 38 in which the bottom portion 10 may be considered to rest upon. In this regard, the plane 34 passing through point 36 is parallel to the plane 38. Both plane 34 and plane 38 would be horizontal planes if the flat plane 38 were, for instance, horizontal and the fan assembly were resting on this plane. For ease of description, it will be assumed that this is the case hereinafter.

Figure 4:
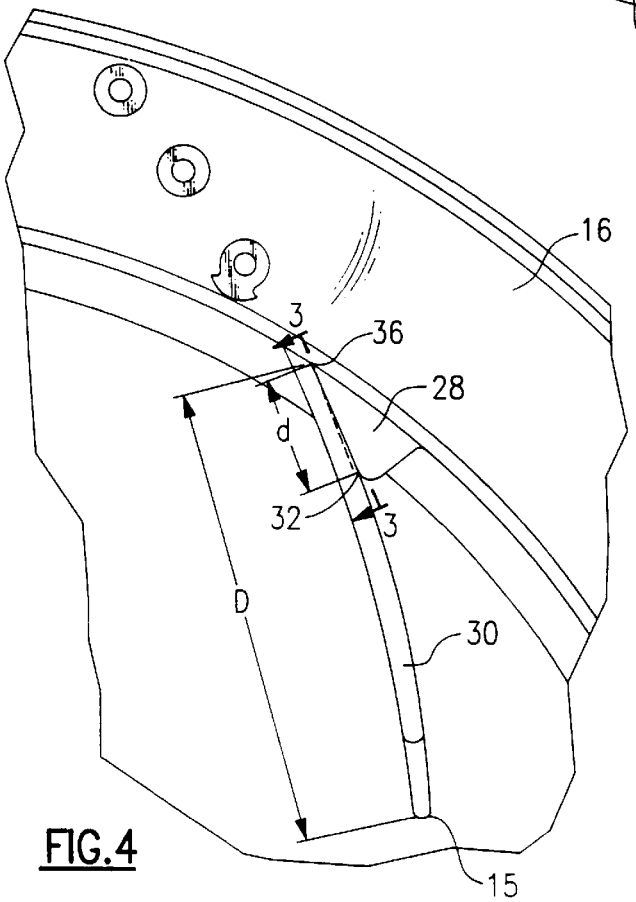
FIG. 4 is a plan view of a single blade and associated support relative to the top ring of the radial fan.

Referring to FIG. 1, the vertical projection of point 15 onto the horizontal plane 34 is denoted as point 15'. As previously noted, the point 15 marks the point at which the leading edge of a blade terminates with respect to the top surface of the bottom portion 10. The vertical projection of point 15 onto the plane 34 can be used to define the straight line distance "D" of the point 15' from the point 36 marking the beginning of the top surface of the web shaped portion 28. This distance "D" is also shown in FIG. 4 as being the straight line distance between point 36 and point 15 in a plan view looking down into the fan assembly. The straight line distance "d" from point 36 to point 32 is also shown in FIG. 2. It is to be understood that this straight line distance would appear in plane 34 as being between the point 36 and a vertical projection of point 32 into this plane. The distances "d" and "D" are hence to be considered as distances lying in the same plane through point 36. The plane is preferably through all similar points defining where all other blade supports begin relative to the respective cantilevered blade portions.

The distance "d" can be expressed relative to the distance "D" as a ratio "d/D" preferably within the range of 0.05 to 0.7 for an angle of inclination θ between zero and thirty degrees. The ratio of d/D for angles of inclination between thirty and forty degrees is preferably within the range of 0.05 and 0.5.

Figure 5:
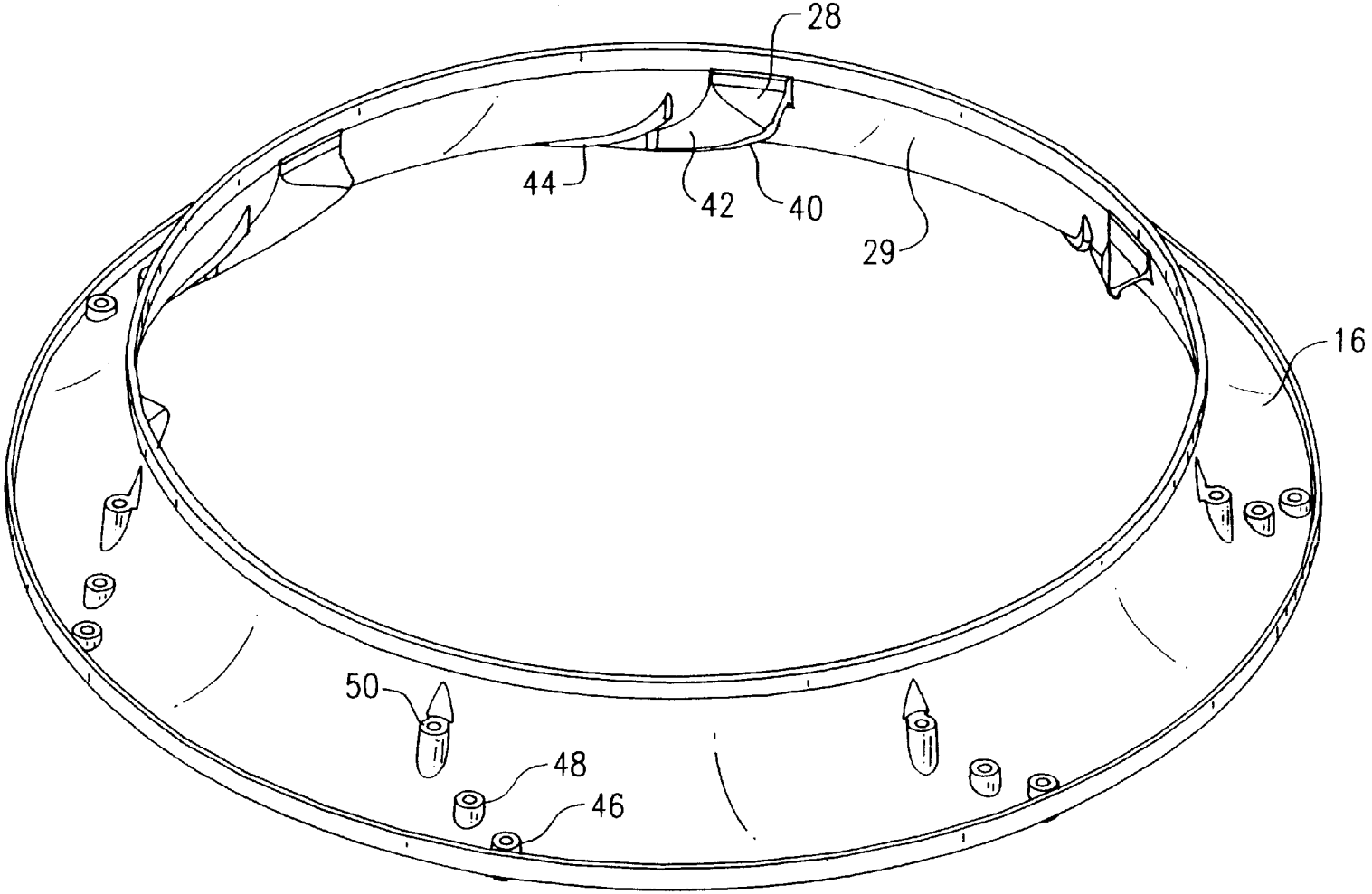
FIG. 5 is a perspective view of the top ring of the radial fan which illustrates several blade support structures.

Referring to FIG. 5, the supporting structure 40 extends downwardly underneath the top ring 16. An alignment edge 42 of the supporting structure conforms to the contour of a surface of the rear blade portion 24. A further alignment device 44 conforms to the opposite surface of the rear blade portion 24. Both the blade support 28 inclusive of the supporting structure 40 and the alignment device 44 are preferably formed with the top ring 16 in a mold so as to be a single unitary molded piece.

Figure 6:
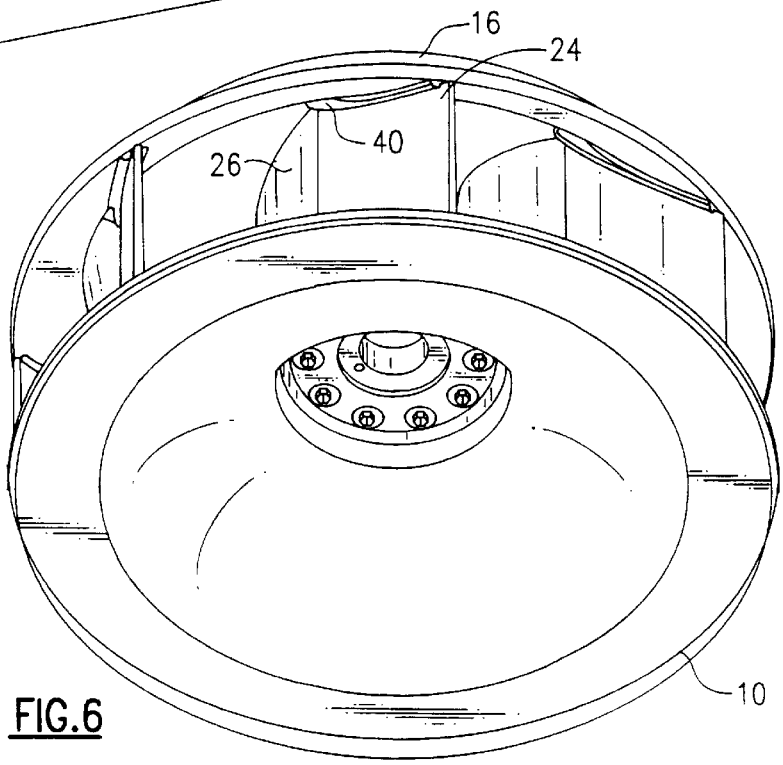
FIG. 6 is a perspective view of the bottom portion of the radial fan of FIG. 1.

Referring to FIG. 6, the rear blade portion 24 is illustrated as fitting into the bottom of the top ring 16. The contour of the surface of the rear blade portion 24 fits snuggly against the alignment edge 42 (not shown in FIG. 6) of the supporting structure. Referring again to FIG. 5, holes such as 46, 48 and 50 in the top ring accommodate the upwardly extending projection 18, 20 and 22 of the rear blade portion when it fits snuggly against the supporting structure 40.

It is to be appreciated that a preferred embodiment of a fan blade assembly with a particular fan blade support for each fan blade has been disclosed. Alterations and modifications to the thus disclosed fan blade assembly may occur without departing from the scope of the present invention. In particular, the shape and orientation of the blades may be different than those shown in the particular embodiment of the fan blade assembly so as to thereby produce a different geometry to the fan blade support itself. Accordingly, the foregoing description of the preferred embodiment is by way of example only and the invention is to be limited by the following claims and equivalents thereto.

What is claimed is:

1. A fan assembly comprising:

a plurality of fan blades extending inwardly from the periphery of the fan assembly;

an outer ring located over the rearward portions of the plurality of fan blades and secured thereto; and a plurality of supports for the plurality of fan blades, each support extending outwardly toward a center of rotation of the fan assembly from an inner wall of said outer ring and furthermore extending along one side of a portion of a respective fan blade for a predefined distance whereby said respective fan blade is supported against centrifugal forces produced during rotation of the fan assembly.

2. The fan assembly of claim 1 wherein each support comprises a web portion conforming to the contour of the inner wall of the outer ring and conforming to the contour of the one side of the portion of the respective fan blade for the predefined distance so as to support the respective fan blade relative to the inner wall of the outer ring.

3. The fan assembly of claim 2 wherein the web portion of each support declines at an angle, θ, relative to a plane passing through a point marking the beginning of where the top surface of the web portion begins to follow the contour of a respective side of a fan blade.

4. The fan assembly of claim 3 wherein the web portion of each support extends along the one side of a portion of a respective fan blade to a point where it intersects a top edge of the respective fan blade.

5. The fan assembly of claim 4 wherein a straight line distance "d" between the beginning point marking the beginning of where the top surface of the web portion begins to follow the contour of the portion of a respective side of a fan blade and a projection of the point wherein the web portion intersects the edge of the respective fan blade into a particular plane must be within a predefined percentage range of a straight line distance, "D" between the beginning point and a projection of a point wherein the leading edge of the respective fan blade terminates into the particular plane.

6. The fan assembly of claim 5 wherein the ratio of "d/D" is in the range 0.05 to 0.7 for an angle θ in the range of zero to thirty degrees.

7. The fan assembly of claim 5 wherein the ratio of "d/D" is in the range 0.05 to 0.5 for an angle θ in the range of thirty to forty degrees.

8. The fan assembly of claim 5 wherein the particular plane passes through the beginning points marking the beginning of where the top surfaces of the web portions of the supports for the respective fan blades follow the contour of the sides of the respective fan blades.

9. The fan assembly of claim 2 wherein the web portion of each support declines at an angle, θ, relative to a plane passing through beginning points marking the beginning of where the top surfaces of the web portions of the supports for the respective fan blades follow the contour of the sides of the respective fan blades.

10. The fan blade assembly of claim 1 wherein each fan blade comprises a first rearward portion lying underneath the outer ring and a second portion extending out from underneath the outer ring and wherein said supports respectively extend for the predefined distance along the second portion extending out from underneath the outer ring.

11. The fan blade assembly of claim 1 wherein said plurality of supports extend underneath the outer ring located over rearward portions of the plurality of fan blades so as to define aligning surfaces for the rearward portions of the respective fan blades.

* * * * *